US011654523B2

(12) United States Patent
Li et al.

(10) Patent No.: US 11,654,523 B2
(45) Date of Patent: May 23, 2023

(54) CEMENT SURFACE GRINDING DEVICE

(71) Applicants: Shun-Jhong Li, New Taipei (TW); Yun-Ciao Wang, Kaohsiung (TW); Yun-Jui Yang, New Taipei (TW)

(72) Inventors: Shun-Jhong Li, New Taipei (TW); Yun-Ciao Wang, Kaohsiung (TW); Yun-Jui Yang, New Taipei (TW)

(73) Assignees: YunJui Yang, Taipei (TW); Shun-Jhong Li, Taipei (TW)

( * ) Notice: Subject to any disclaimer, the term of this patent is extended or adjusted under 35 U.S.C. 154(b) by 140 days.

(21) Appl. No.: 17/120,293

(22) Filed: Dec. 14, 2020

(65) Prior Publication Data

US 2022/0184767 A1 Jun. 16, 2022

(51) Int. Cl.
*B24B 7/18* (2006.01)
*B28D 1/00* (2006.01)

(52) U.S. Cl.
CPC ..... *B24B 7/186* (2013.01); *B28D 1/00* (2013.01)

(58) Field of Classification Search
CPC ..... B24B 7/186; B24B 7/18; B24B 7/242; B24B 7/244; B24B 23/02; B24B 23/04; B24B 23/03; B24B 23/0007; B24B 41/002; B24B 41/0047; B24B 41/053; B24B 23/005
USPC ..... 451/278, 350, 353, 357, 359, 360
See application file for complete search history.

(56) References Cited

U.S. PATENT DOCUMENTS 5,637,032 A * 6/1997 Thysell ..... B24B 7/186 451/259
7,490,813 B1 * 2/2009 Weddle ..... B66F 3/24 248/354.1
2003/0040265 A1 * 2/2003 Palushi ..... B24B 7/186 451/352
2006/0073776 A1 * 4/2006 Gallup ..... B24B 41/047 451/353
2010/0190421 A1 * 7/2010 Hamm ..... B24B 7/186 451/353
2021/0237220 A1 * 8/2021 Spears ..... B24B 7/186

FOREIGN PATENT DOCUMENTS

CN 10843728 A * 8/2018

* cited by examiner

*Primary Examiner* — Anne M Kozak
*Assistant Examiner* — Tyler James McFarland

(57) ABSTRACT

A cement surface grinding device includes a central disk which is extended upwards with a central shaft; the central disk being rotary with respect to the central shaft; at least one outer rotary disk arranged around the central disk; a bottom of the outer rotary disk being installed with a grinding sheet; and a rotary frame arranged above the central disk and the at least one outer rotary disk; the rotary frame including a connecting frame and a plurality of connecting rods; an upper side of the central shaft being connected to a central hole of a seat and the seat being connected to a lower side of the connecting frame; each outer rotary disk being formed with an outer belt wheel and the central disk being formed with a connecting element; and a belt winding around the connecting element and the outer belt wheel.

18 Claims, 5 Drawing Sheets

CEMENT SURFACE GRINDING DEVICE

FIELD OF THE INVENTION

The present invention is related to cement grinding, and in particular to a cement surface grinding device.

BACKGROUND OF THE INVENTION

In civil engineering, it is often necessary to pave cement on ground. Firstly, wet cement is paved on the ground, and then grinding knives are used to flat the cement. The grinding knives are installed on a vehicle which has a grinding knife device which has a rotatable frame and a plurality of grinding knives installed on the frame. The grinding knives have the function of flattening wet cement ground.

In above mentioned prior art, the grinding knives cannot completely flat the ground because after the cement is solidified, the cement ground is still uneven. This is not beneficial for the succeeding works and it also presents an unbeautiful outlook. If it is desired to flatten the solidified cement ground, another tools are necessary. This causes overall cost to be increased.

SUMMARY OF THE INVENTION

Accordingly, the object of the present invention is to provide a cement surface grinding device, wherein a connecting frame is installed with a replaceable central disk and at least one outer rotary disk and the bottom of the outer rotary disk is arranged with at least one grinding sheet. The connecting frame on a cement grinding vehicle may be original installed with grinding knives. In use, it is only needed to detach the grinding knives, and then the central disk and the outer rotary disk are installed thereon. Then by moving the vehicle, the cement surface can be ground. Therefore, the use of the present invention is very convenient. No more vehicle is needed. In the present invention, the outer rotary disks are arranged on the periphery of the central disk so as to have a large grinding area. By the revolution of the outer rotary disks with respective to the central disk and the rotation of the outer rotary disks, the cement surface may be ground effectively so that the whole cement surface is uniformly ground to present a beautiful outlook. This is beneficial to the succeeding works.

To achieve above object, the present invention provides cement surface grinding device, comprising: a central disk; a center of the central disk being connected and extended upwards with a central shaft; the central disk being rotary with respect to the central shaft; a bottom of the central disk being installed with a central pad; at least one outer rotary disk arranged around the central disk; a bottom of the outer rotary disk being installed with a grinding sheet; a rotary frame arranged above the central disk and the at least one outer rotary disk; the rotary frame including a connecting frame and a plurality of connecting rods; an upper side of the central shaft being connected to a central hole of a seat and the seat being connected to a lower side of the connecting frame; an inner end of the connecting rod being detachably connected to a respective outer end of the connecting frame; an outer end of the connecting rod being connected to a respective one of the outer rotary disk; a center of the connecting frame being a through hole; each outer rotary disk being formed with an outer belt wheel and the central disk being formed with a connecting element; a belt winding around the connecting element and the outer belt wheel; wherein in operation, the through hole of the connecting frame serves to receive an outer driving source so as to drive the connecting frame of the rotary frame to rotate and then the plurality of connecting rods and the central shaft are driven to rotate; rotation of the connecting frame will drive the outer rotary disks to rotate around a periphery of the central disk, while the central disk does not rotate so that the belt drive the outer belt wheel to rotate and thus the outer rotary disks are driven to rotate; by the rotation of the outer rotary disks and the revolution of the outer rotary disk with respective to the central disk, the outer grinding sheets are driven to grind the cement surface; the cement surface is a concrete surface in that the cement is solidified.

DETAILED DESCRIPTION OF THE INVENTION

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 1 to 5, the structure of the present invention is illustrated.

A central disk 10 is included. A center of the central disk 10 is connected and extended upwards with a central shaft 11. The central disk 10 is rotary with respect to the central shaft 11. A bottom of the central disk 10 is installed with a central pad 15 which is slide proof, such as made of rubber.

Figure 1:
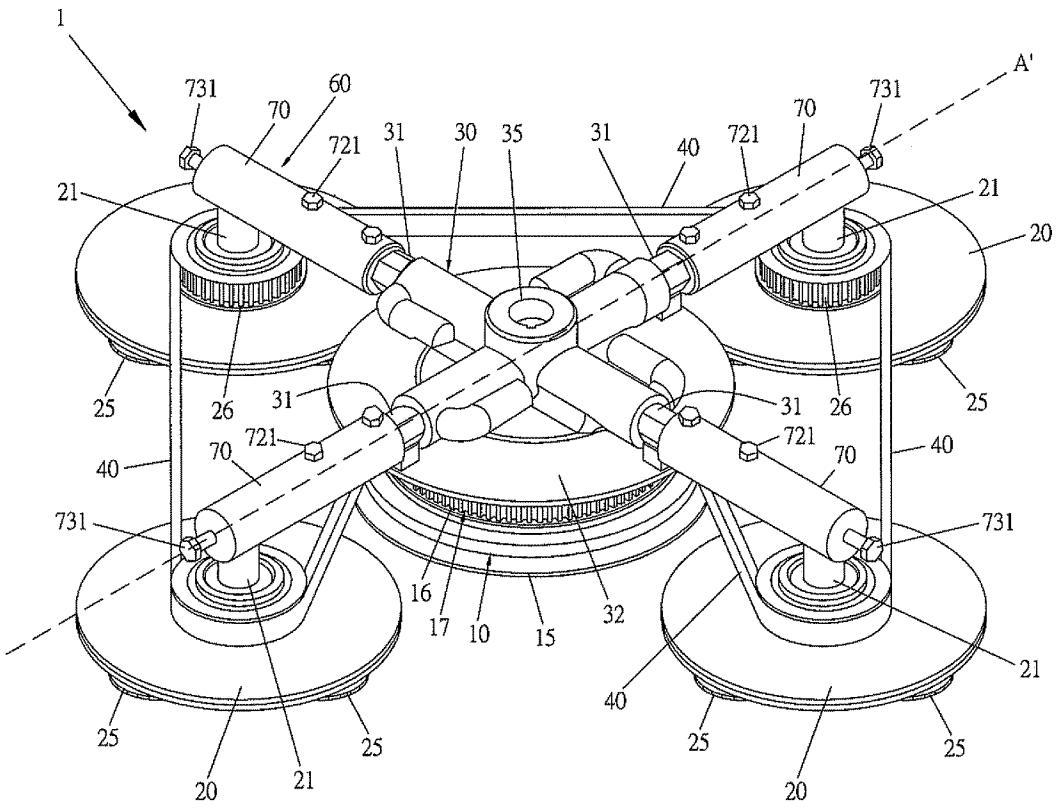
FIG. 1 is a schematic view showing the assembly of the elements of the present invention.
Figure 2:
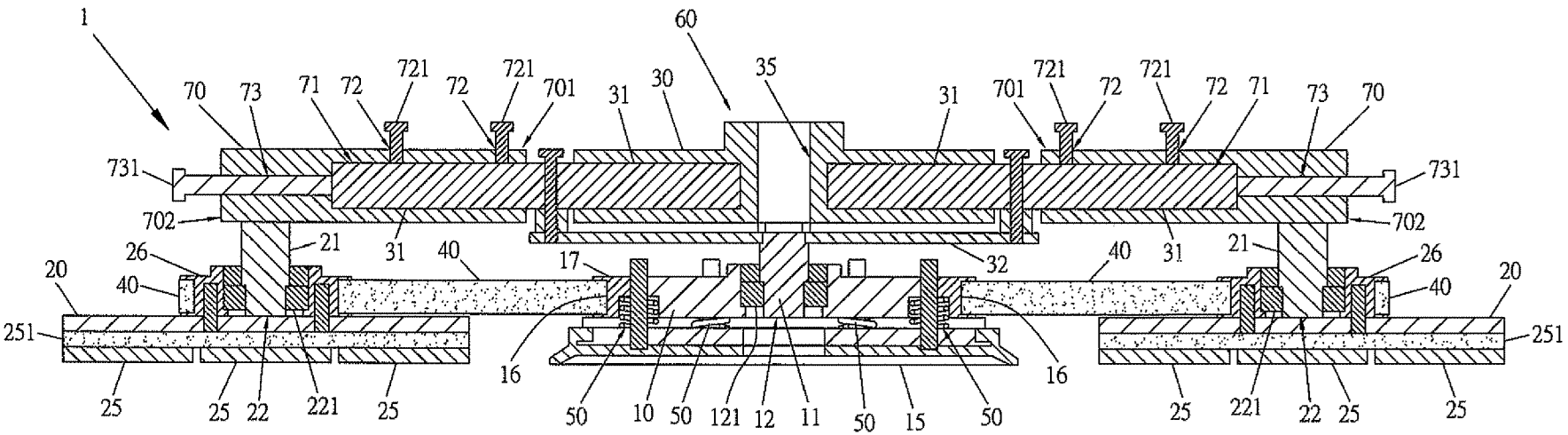
FIG. 2 is a schematic cross section view along line A-A' in FIG. 1.
Figure 3:
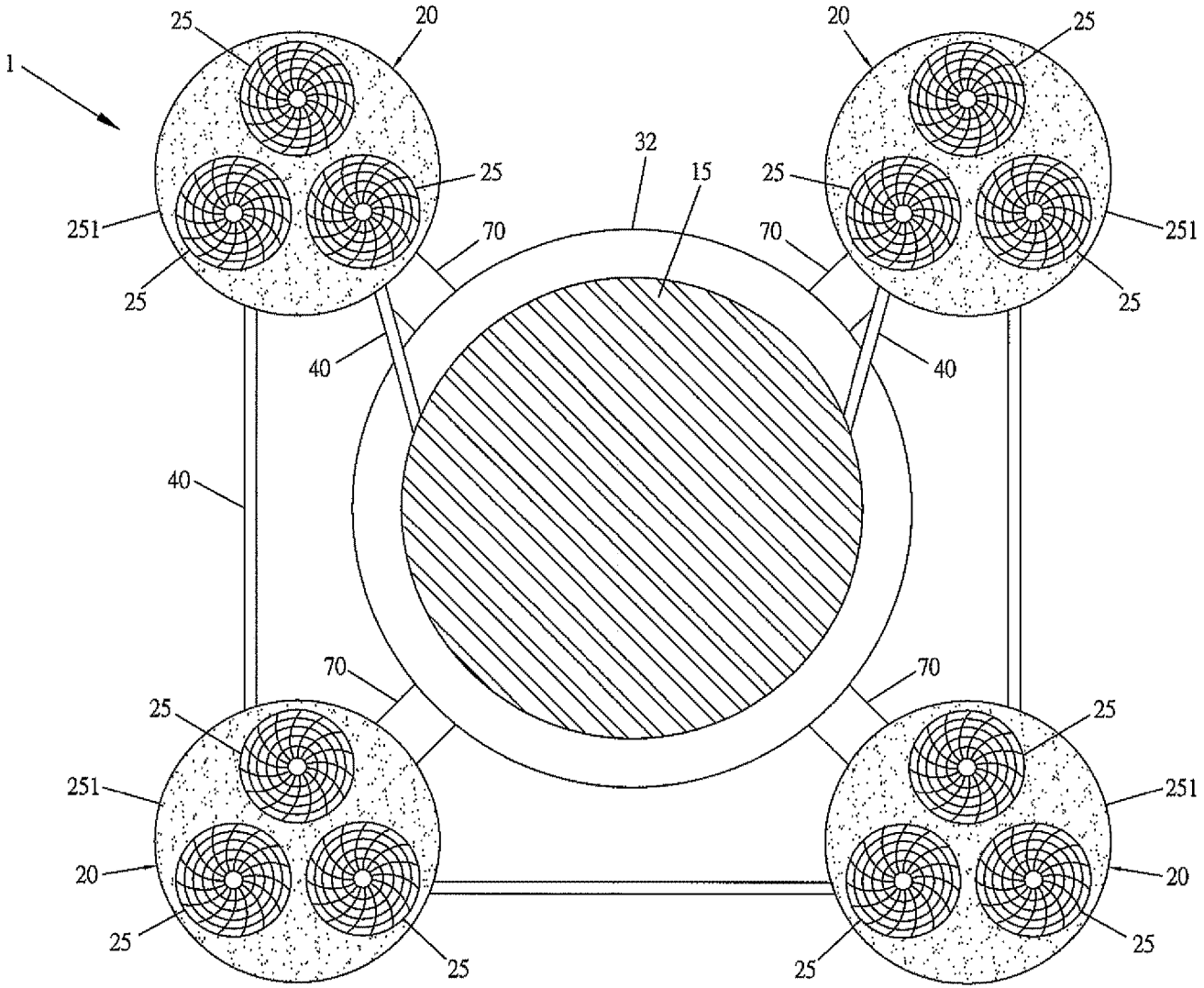
FIG. 3 is a bottom view of the present invention.

At least one outer rotary disk 20 are arranged around the central disk 10. Preferably there are a plurality of outer rotary disks 20, such as there are four or five outer rotary disks 20. FIG. 1 shows a structure which includes four outer rotary disks 20 which are arranged with equal space. A bottom of the outer rotary disk 20 is installed with a grinding sheet 25. Preferably, there are a plurality of grinding sheets 25. FIGS. 2 and 3 show a structure which includes three grinding sheets 25. The plurality of grinding sheets 25 of each outer rotary disk 20 are distant with an equal space and are arranged circularly around a periphery of the outer rotary disk 20. Between one outer rotary disk 20 and the respective grinding sheet 25 is arranged with an elastic structure 251 which the grinding sheet 25 can sufficient adhere on the ground. The elastic structure 251 may be a rubber pad or a spring.

Figure 4:
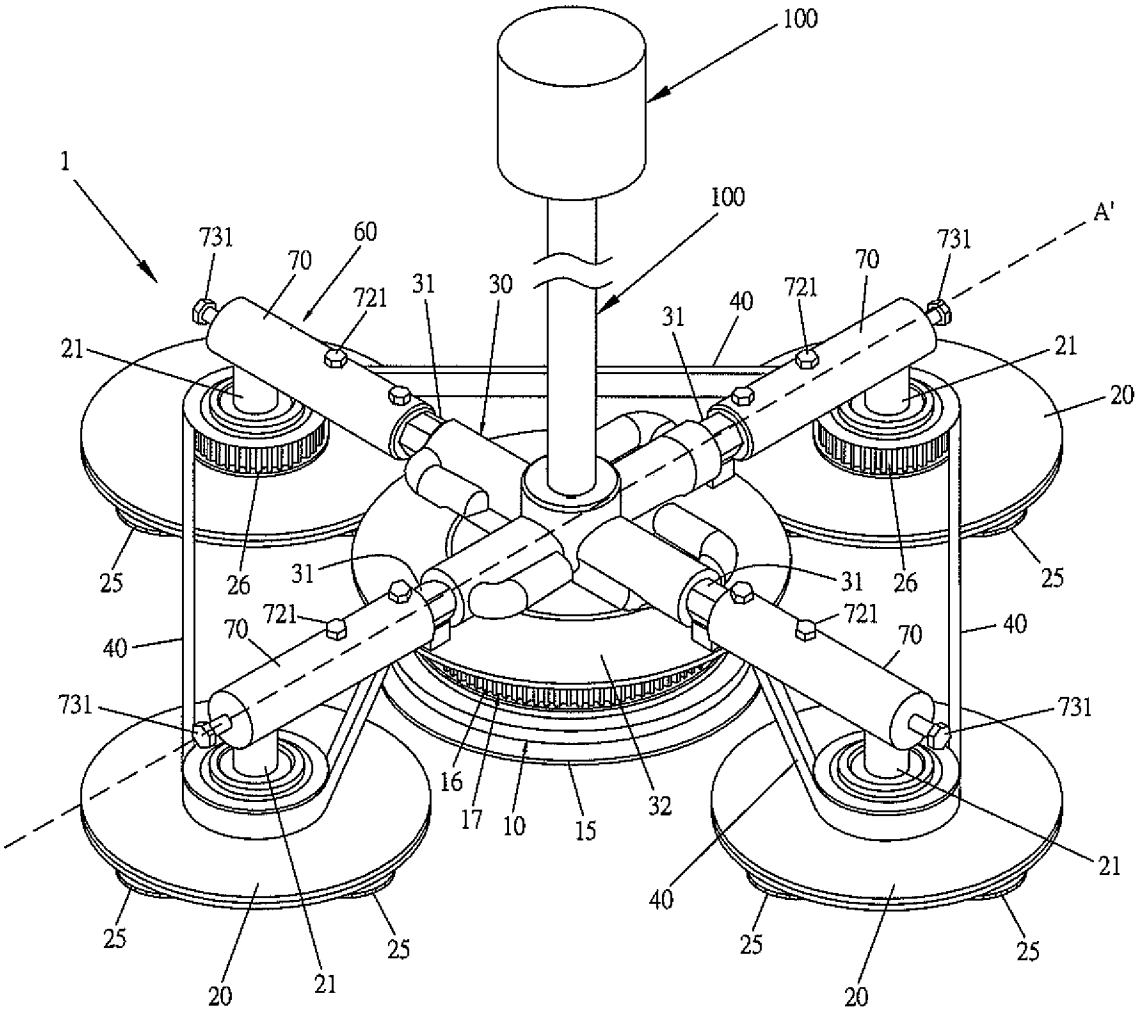
FIG. 4 is a schematic view showing the application of the present invention.
Figure 5:
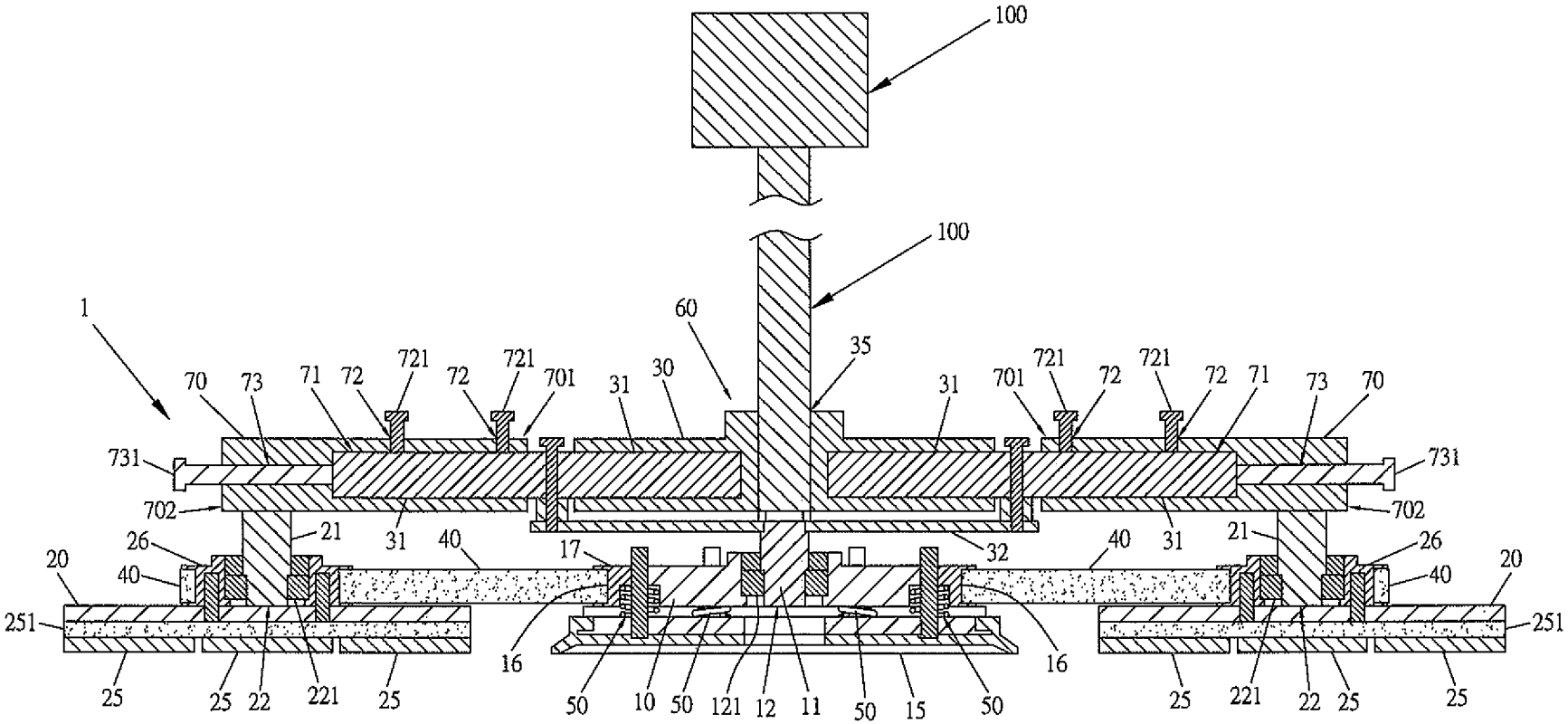
FIG. 5 is a schematic cross section view along line B-B' of FIG. 4.

A rotary frame 60 is arranged above the central disk 10 and the at least one outer rotary disk 20. The rotary frame 60 includes a connecting frame 30 and a plurality of connecting rods 70. An upper side of the central shaft 11 is connected to a central hole of a seat 32 and the seat 32 is connected to a lower side of the connecting frame 30. An inner end 701 of the connecting rod 70 is detachably connected to a respective outer end of the connecting frame 30. An outer end 702 of the connecting rod 70 is connected to a respective one of the outer rotary disk 20. A center of the connecting frame 30 has a through hole 35. As illustrated in FIGS. 4 and 5, in operation, the through hole 35 of the connecting frame 30 serves to be connected with an outer driving source 100 (such as a motor or an engine) so as to drive the connecting frame 30 of the rotary frame 60 to rotate and then the plurality of connecting rods 70 and the central shaft 11 are driven to rotate.

The connecting frame 30 includes a plurality of supporting rods 31. Each supporting rod 31 is inserted into a connected hole 71 in the inner end 701 of the connecting rod 70.

Each outer rotary disk 20 is formed with an outer belt wheel 26 and the central disk 10 is formed with a connecting element 17. A belt 40 winds around the connecting element 17 and the outer belt wheel 26.

Rotation of the connecting frame 30 will drive the outer rotary disks 20 to rotate around a periphery of the central disk 10, while the central disk 10 does not rotate so that the belt 40 drive the outer belt wheel 26 to rotate and thus the outer rotary disks 20 are driven to rotate. By the rotation of the outer rotary disks 20 and the revolution of the outer rotary disk 20 with respective to the central disk 10, the outer grinding sheets 25 are driven to grind the cement surface. The cement surface is a concrete surface in that the cement is solidified.

In practical use, the cement grinding device 1 of the present invention is installed to the bottom of a vehicle (not shown). The vehicle is installed with grinding knives (not shown). In the present invention, the connecting frame 30 of the rotary frame 60 is a frame which is the original frame for installing the grinding knives. In use the grinding knives are detached from supporting rods 31 of the connecting frame 30 and the plurality of connecting rods 70 are installed to the supporting rods 31. Then the upper end of the central shaft 11 is connected to the lower side of the connecting frame 30 through the seat 32. Since the driving source 100 of the vehicle is connected to the through hole 35 of the connecting frame 30, it can drive the rotary frame 60 to further drive the outer grinding sheets 25 of the outer rotary disk 20 to cause the grinding sheets 25 of the outer rotary disk 20 to revolve around the central disk 10 and the outer grinding sheets 25 also rotate. By movement of the vehicle, the cement surface is ground so that the surface of the cement surface is flattened. In use, the bottom of the vehicle can be arranged with a plurality of cement surface grinding device 1 of the present invention.

A center of the outer rotary disk 20 has an installing hole 22. An inner side of the installing hole 22 is installed with a bearing 221. A shaft body 21 extends from the outer end 702 of each connecting rod 70 and then enters into the bearing 221 in the installing hole 22 of the outer rotary disk 20 so that the outer rotary disk 20 rotates with respect to the shaft body 21. A center of the central disk 10 has a through hole 12. The through hole 12 of the central disk 10 has a bearing 121. The central shaft 11 is connected to the bearing 121 of the through hole 12 of the central disk 10.

The connecting element 17 of the central disk 10 is a rotatable central belt wheel 16 which is coaxial with the central shaft 11. The belt 40 is combined to the outer belt wheel 26 and the central belt wheel 16. The outer belt wheel 26 is coaxial with the shaft body 21.

One side of each connecting rod 70 has a plurality of retaining holes 72 which are communicated with respective connecting holes 71. Each retaining hole 72 is installed with a retaining screw 721 for retaining connecting rod 70 in the connecting hole 71.

An outer side of each connecting rod 70 is formed with a screw hole 73 which is communicated with the respective connecting hole 71. An adjustable screw 731 is installed within the screw hole 73. When the adjustable screw 731 moves inwards, it will resist against the supporting rod 31 in the connecting hole 71 so that the connecting rod 70 moves outwards so that the respective outer rotary disk 20 and outer belt wheel 26 move outwards. As a result, the outer belt wheel 26 pushes the belt 40 outwards so as to increase the combining strength between the belt 40 and the outer belt wheel 26.

As illustrated in FIG. 2, a plurality of springs 50 are arranged between the central disk 10 and the central pad 15. When the central pad 15 or the outer grinding sheets 25 are worn and become thinner, the springs 50 will push the central pad 15 so that the central pad 15 and the outer grinding sheets 25 are retained in same plane so as to retain the steadiness of the whole cement surface grinding device 1 of the present invention.

Advantages of the present invention are that a connecting frame is installed with a replaceable central disk and at least one outer rotary disk and the bottom of the outer rotary disk is arranged with at least one grinding sheet. The connecting frame on a cement grinding vehicle may be original installed with grinding knives. In use, it is only needed to detach the grinding knives, and then the central disk and the outer rotary disk are installed thereon. Then by moving the vehicle, the cement surface can be ground. Therefore, the use of the present invention is very convenient. No more vehicle is needed. In the present invention, the outer rotary disks are arranged on the periphery of the central disk so as to have a large grinding area. By the revolution of the outer rotary disks with respective to the central disk and the rotation of the outer rotary disks, the cement surface may be ground effectively so that the whole cement surface is uniformly ground to present a beautiful outlook. This is beneficial to the succeeding works.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A cement surface grinding device, comprising:

a central disk; a center of the central disk being connected and extended upwards with a central shaft; the central disk being rotatable with respect to the central shaft; a bottom of the central disk being installed with a central pad;

at least one outer rotary disk arranged around the central disk; a bottom of the outer rotary disk being installed with a grinding sheet;

a rotary frame arranged above the central disk and the at least one outer rotary disk; the rotary frame including a connecting frame and a plurality of connecting rods; an upper side of the central shaft being connected to a central hole of a seat and the seat being connected to a lower side of the connecting frame; an inner end of the connecting rod being detachably connected to a respective outer end of the connecting frame; an outer end of the connecting rod being connected to a respective one of the outer rotary disk; a center of the connecting frame being a through hole; each outer rotary disk being formed with an outer belt wheel and the central disk being formed with a connecting element; a belt winding around the connecting element and the outer belt wheel;

wherein in operation, the through hole of the connecting frame serves to receive an outer driving source so as to drive the connecting frame of the rotary frame to rotate and then the plurality of connecting rods and the central shaft are driven to rotate; rotation of the connecting frame will drive the at least one outer rotary disk to rotate around a periphery of the central disk, the belt drives the outer belt wheel to rotate and thus the at least one outer rotary disk is driven to rotate; by the rotation of the at least one outer rotary disk and the revolution of the at least one outer rotary disk with respective to the central disk, the outer grinding sheets are driven to grind the cement surface; and the cement surface is a concrete surface in that the cement is solidified.

2. The cement surface grinding device as claimed in claim 1, wherein the at least one outer rotary disk is a plurality of outer rotary disks.

3. The cement surface grinding device as claimed in claim 1, wherein the at least one outer rotary disk is four or five outer rotary disks.

4. The cement surface grinding device as claimed in claim 1, wherein the at least one outer grinding sheet is a plurality of grinding sheets.

5. The cement surface grinding device as claimed in claim 1, wherein the at least one outer grinding sheet is three grinding sheets.

6. The cement surface grinding device as claimed in claim 4, wherein the plurality of grinding sheets of each outer rotary disk are arranged circularly around a periphery of the outer rotary disk.

7. The cement surface grinding device as claimed in claim 1, wherein the plurality of grinding sheets of the outer rotary disk are distant with an equal space.

8. The cement surface grinding device as claimed in claim 1, wherein between one of the at least one outer rotary disk and the respective grinding sheet is arranged with an elastic structure by which the grinding sheet can sufficient adhere on the ground.

9. The cement surface grinding device as claimed in claim 8, wherein the elastic structure is selected from a rubber pad or a spring.

10. The cement surface grinding device as claimed in claim 1, wherein the central pad is made of slide proof material.

11. The cement surface grinding device as claimed in claim 1, wherein a center of the outer rotary disk has an installing hole; an inner side of the installing hole is installed with a bearing; a shaft body extends from the outer end of each connecting rod and then enters into the bearing in the installing hole of the outer rotary disk so that the outer rotary disk rotates with respect to the shaft body; a center of the central disk has a through hole; the through hole of the central disk has a bearing; and the central shaft is connected to the bearing of the through hole of the central disk.

12. The cement surface grinding device as claimed in claim 1, wherein the connecting element of the central disk is a rotatable central belt wheel which is coaxial with the central shaft; the belt is combined to the outer belt wheel and the central belt wheel; and the outer belt wheel is coaxial with the shaft body.

13. The cement surface grinding device as claimed in claim 1, wherein the connecting frame includes a plurality of supporting rods; and each supporting rod is inserted into a connecting hole in the inner end of the connecting rod.

14. The cement surface grinding device as claimed in claim 13, wherein one side of each connecting rod has a plurality of retaining holes which are communicated with respective connecting holes; and each retaining hole is installed with a retaining screw for retaining the supporting rod in the connecting hole.

15. The cement surface grinding device as claimed in claim 13, wherein an outer side of each connecting rod is formed with a screw hole which is communicated with the respective connecting hole; an adjustable screw is installed within the screw hole; when the adjustable screw moves inwards, it will resist against the supporting rod in the connecting hole so that the connecting rod moves outwards to cause that the respective outer rotary disk and outer belt wheel move outwards.

16. The cement surface grinding device as claimed in claim 1, wherein a plurality of springs are arranged between the central disk and the central pad; when the central pad or the outer grinding sheets are worn and become thinner, the springs will push the central pad so that the central pad and the outer grinding sheets are retained in same plane so as to retain the steadiness of a entirety of the cement surface grinding device.

17. The cement surface grinding device as claimed in claim 1, wherein the cement surface is solidified cement surface.

18. The cement surface grinding device as claimed in claim 1, wherein the driving source is a motor or an engine.

* * * * *